United States Patent [19]

Blassel et al.

[11] 4,217,550

[45] Aug. 12, 1980

[54] RADIO JAMMING DEVICE

[76] Inventors: Pierre P. Blassel; Paul M. Jacquet, both of Paris, France

[21] Appl. No.: 226,792

[22] Filed: Sep. 28, 1962

[51] Int. Cl.[2] ..... H04K 3/00

[52] U.S. Cl. ..... 455/1; 343/18 E

[58] Field of Search ..... 343/18 E

[56] References Cited

U.S. PATENT DOCUMENTS

| | | | |
|---|---|---|---|
| 2,885,543 | 5/1959 | Williams | 325/132 |
| 2,972,119 | 2/1961 | Ford et al. | 325/132 |
| 3,517,388 | 6/1970 | Vermillon | 325/132 |

*Primary Examiner*—Howard A. Birmiel

*Attorney, Agent, or Firm*—Abraham A. Saffitz

EXEMPLARY CLAIM

1. A jamming device adapted to jam a given frequency band with the exception of a particular jam-free band included in said given frequency band, comprising a transmitter tube generating a radiofrequency carrier signal, means for blocking said tube, means for frequency-modulating said carrier signal, means connected to said frequency-modulating means for generating a modulation signal having an amplitude versus time waveform including a first saw-tooth and a second saw-tooth, both having two portions in which respectively the amplitude of the modulation signal increases and decreases with respect to time, and a linear portion in which the amplitude of the modulation signal abruptly varies from the amplitude value at the end of the first saw-tooth to the amplitude value at the beginning of second saw-tooth, the variation direction of the modulation signal amplitude on both sides of the linear portion of the waveform being opposite the direction of said variation along said linear portion, means for deriving blocking signals from the passage of the frequency of the frequency-modulated signal through the jam-free band and means for applying said blocking signals to said blocking means.

4 Claims, 10 Drawing Figures

RADIO JAMMING DEVICE

This invention relates to jamming devices adapted to jam radiofrequency foe communications and more particularly radar operations while not affecting, at the same time, friendly communications utilizing parts of the jammer range of operating frequencies.

The jamming device of the present invention is of the general type designed to jam radiofrequency communications over a large frequency bandwidth and is particularly suited for airborne operation. It perturbs the operation of every receiving radiocommunication or radar set located within the jamming frequency band and within the spatial range of the jamming transmitter set, without the necessity for prior radiofrequency or spatial location of the sets to be jammed.

Jammers of the abovementioned type generally comprise a frequency modulation transmitter with a modulation index so selected that the frequency spectrum covers the whole band to be jammed. However prior art wide-band jammers of that type suffer from one inherent and major drawback. While the operation of the transmitter denies the hostile side a whole range of radiofrequencies, it also presents the risk of perturbing the operation of friendly communication or radar transmitter and receiver sets operating on the same range of frequencies. By way of consequence, while aircraft detection by hostile devices is prevented, those same aircraft may run the risk of flying blind being deprived of the help of their own navigational facilities: radar and radio. Ground based radio facilities can also be disrupted. In order to suppress or overcome these drawbacks, it had already been suggested that one or several frequency bands be alloted, within the jammed band, for the operation of friendly radiofrequency devices, radar or other systems. Such bands, unaffected by jamming will be hereinafter referred to as "protected bands". In order to ensure efficient protection, it is necessary that the ratio of power densities radiated over the jammed and protected frequency bands respectively be very high. A difference of at least 40 decibels must be achieved to provide a useful protection device.

The object of the present invention is to provide an active jammer operating over a wide range of frequencies and featuring, within that range of frequencies, one or several protected bands allocated to friendly services, the ratio of radiated power densities over the jammed and protected bands of frequencies being as high as practically permissible and, in any case, higher than 40 decibels.

In order to cover a wide range of frequencies, the transmitted jamming signal will embody a certain amount of frequency modulation. The most simple type of frequency modulation suitable for the purpose is a saw-tooth modulation. At first sight, it might appear that a relatively easy method for providing a certain number of protected bands within the jamming range would consist in cutting-off the transmitted jamming signal at the very instant when its instantaneous frequency goes through the protected band.

In actual practice, the expected result is not obtained. The amplitude modulation initiated by the blocking of the transmitted signal creates, within the frequency spectrum of the jamming signal a number of additional sidebands. Such sidebands set up a certain amount of smudge within and on either side of the protected band. Moreover secondary phenomenons occuring at the time of blocking and release of the jammer transmitter tube also produces unwanted sidebands.

In the invention, the modulation signal of the jamming transmitter is no longer of the conventional saw-tooth type. At the instants when the instantaneous frequency of the jammer is about to go through or had just gone out the protected band the instantaneous frequency is provided with a rapid additional modulation rate which, combined with the blocking of the modulated output signal, prevents the setting-up of sidebands within the protected band.

According to a first embodiment of the invention, the instantaneous frequency of the F.M. jamming signal is subjected, shortly before its incursion into the protected band and shortly after it leaves that band to a very fast variation rate of the same direction before and after the protected band, said direction being opposite that of the variation of the instantaneous frequency within the protected band. The modulated output signal is blocked both during the time the instantaneous frequency goes through the protected band and during the time the instantaneous frequency goes back from the value it has reached at the end of a modulation cycle to the value it do have at the beginning of the next cycle. The waveform of the modulation signal in an "instantaneous frequency versus time" graph is symmetrical with respect to the mid-frequency $(f_1+f_2)/2$ of the protected band and with respect to the time T at which said mid-frequency is reached; it comprises a first saw-tooth portion having first a gradual sloping-up part and then an abrupt sloping-down part, an abrupt sloping-up portion corresponding to the protected band and a second saw-tooth portion having first an abrupt sloping-down portion and then a gradual sloping-up portion. The peak of the first saw-tooth portion is at the lower frequency limit $f_1$ of the protected band and the valley of the second saw-tooth portion is at the upper frequency limit $f_2$ of said protected band. The instantaneous frequency satisfies the relationship: $f(T+t)+f(T-t)=f_1+f_2$.

According to a second embodiment of the invention, the instantaneous frequency of the jamming of the F.M. jamming signal is subjected, shortly before its incursion into the protected band to a rather gradual variation rate and shortly after it leaves that band to a very fast variation rate, this two variation rates having the same direction, said direction being opposite that of the variation of the instantaneous frequency within the protected band. The modulated output signal is blocked both during the time the instantaneous frequency goes through the protected band and during the "fly-back" time between two successive modulation cycles. The waveform of the modulation signal in an "instantaneous frequency versus time" graph is symmetrical with respect to the mid-frequency $(f_1+f_2)/2$ of the protected band and in phase-quadrature relationship with respect to time; it comprises a first saw-tooth portion having first an abrupt sloping-up part and then a gradual sloping-down part, an abrupt sloping-up portion corresponding to the protected band and a second saw-tooth portion having first an abrupt sloping-down portion and then a gradual sloping-up portion. The peak of the first saw-tooth portion is at the lower frequency limit $f_1$ of the protected band and the valley of the second saw-tooth portion is at the upper frequency limit $f_2$ of said protected band. The instantaneous frequency satisfies the relationship:

$$f(T+t)+f(T+T/2+t)=f_1+f_2$$

The device according to the invention will be hereinafter described with reference to accompanying drawing in which:

FIG. 1 illustrates in block diagram a jamming station;

FIGS. 2*a* and 2*b* show respectively the modulation signal of a frequency modulation jammer of the prior art and the blocking signal of said jammer, and the corresponding jamming signal spectrum;

FIGS. 3*a* and 3*b* show respectively the modulation signal of the frequency modulation jammer according to the first embodiment of the invention and the corresponding jamming signal spectrum;

FIGS. 4*a* and 4*b* show respectively the modulation signal of the frequency modulation jammer according to the second embodiment of the invention and the corresponding jamming signal spectrum;

Figure 1:
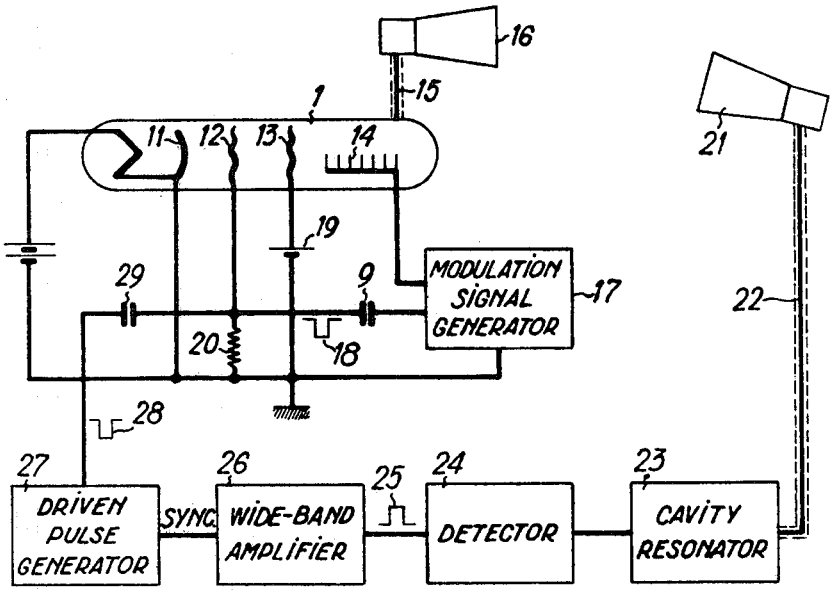

Referring first to FIG. 1, there is shown a transmitter tube 1 adapted to produce a wide-band frequency modulated signal. Tube 1 is a microwave transmitting tube of the carcinotron type. Carcinotron tubes are well known in the art and are for example fully described in British Pat. No. 699,893 filed Apr. 3, 1952 and issued to the Compagnie Générale de Télégraphie sans fil. Tube 1 comprises cathode 11, control grid 12, suppressor grid 13, delay-line 14 and coaxial output line 15. It is well known that delay-line 14 serves to slow down the velocity of the radiofrequency travelling wave in the tube whose electric field interacts with the electrons of the electron beam. 19 designates a current source for biasing suppressor grid 13. The instantaneous frequency of the frequency modulated output signal of carcinotron 1 is a substantially linear function of the instantaneous value of the potential of delay-line 14. The potential of said delay-line 14 is driven by modulation signal generator 17. The same generator also produces blocking pulses 18 which are applied across the terminals of biasing resistor 20 through capacitor 9 for controlling the potential of grid 12.

The frequency modulated output signal of carcinotron 1 is radiated through transmitting horn 16. An auxiliary horn 21 located in the vicinity of transmitting horn 16 picks-up a small amount of the radiated radiofrequency energy and feeds it back to a cavity resonator 23 through microwave transmission line 22. Cavity resonator 23 is tuned to the mid-frequency of the protected band. The output signal of cavity resonator 23 is detected by detector 24, which produces a video frequency pulse 25 at the very instant when the transmitter frequency goes through the pass-band of cavity resonator 23. Pulses 25 are amplified by video amplifier 26 and drives pulse generator 27. The output pulses 28 of amplifier 26 are applied across biasing resistor 20 of control grid 12 through capacitor 29 and cut-off the carcinotron.

Figure 2A:
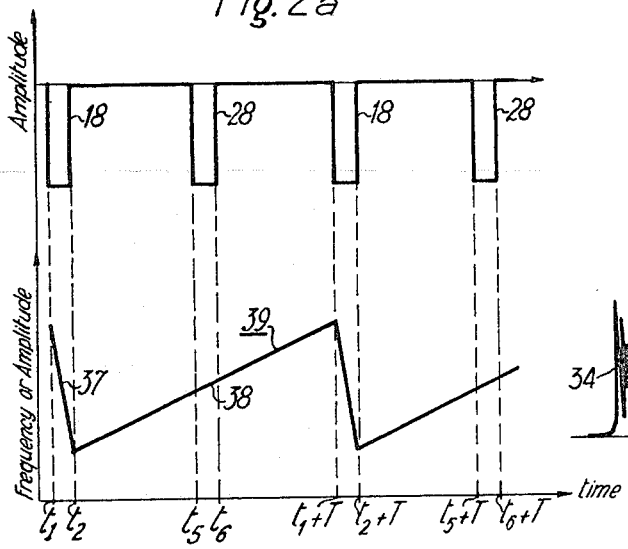

FIG. 2*a* represents the blocking pulses 18,28 and the waveform of the modulation signal 39 applied to the control grid in the frequency modulated jammer of the prior art. In these jammers, generator 17 is a conventional saw-tooth generator. The voltage of grid 12 is substantially negative during the fly-back periods ($t_1-t_2$) between two successive saw-teeth and during the scanning periods ($t_5-t_6$) of the protected band ($f_1-f_2$). During the parts 37 and 38 of the instantaneous frequency variation, the tube is cut-off.

Figure 2B:
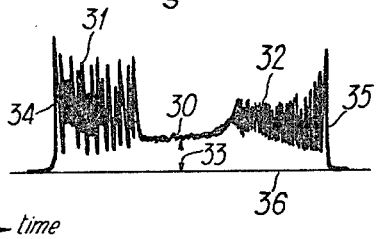

A spectrum analyser was employed to record the spectrum of the signal generated by the jammer of FIG. 1, under the above conditions. The spectrum is shown in FIG. 2*b*. Frequencies are recorded in abscissa and radiated powers in ordinate. It can be readily observed that jamming takes place between the frequencies corresponding respectively to rise 34 and decay 35. Frequencies below the protected band appear in 31. Frequencies above the protected band appear in 32. The trough corresponding to the protected band itself appears in 30. If the protected band featured total protection, trough 30 would reach down to the base line 36. In actual fact, there subsists over the protected band a certain amount of radiated power represented by ordinate 33. To quote a specific case, the protection provided by a prior art jammer was 12 db.

It is difficult to analyse quantitatively the causes of this inadequacy. They are of diverse origins and include:

(i)—The generation of frequency sidebands due to the sharp modulation effect occurring at the time of radiated frequency cut-off.

(ii)—A frequency "pushing" phenomenon: the frequency of the signal generated by the carcinotron increases as the intensity of the electronic beam decreases, that is at the moment of cut-off, whether grid or anode cut-off. At the time of release, the frequency decreases. Thus cut-off is followed by a frequency increase and unblocking by a frequency decrease. This "pushing" effect becomes more severe when the supply voltage of the delay-line increases during cut-off, because increase of frequency due to blocking and increase of frequency due to increase of delay-line voltage add together.

Whatever the relative importance of these and possibly other causes, the object of the invention is to counter them.

Figure 3A:
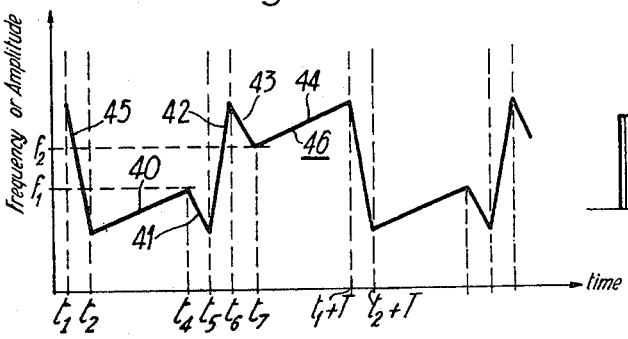

FIG. 3*a* represents both the modulation signal produced by generator 17 and the instantaneous frequency of the frequency modulated signal according to the first embodiment of the invention. The signals applied to control grid 12 are the blocking pulses 18 and 28 of FIG. 2*a*. Signal 46 of FIG. 3*a* is applied to the delay-line 14. Signal 46 differs from signal 39 in FIG. 2*a*, in that: at time $t_4$, shortly before time $t_5$, slope 40 of the representative curve is interrupted by a sharp frequency drop represented by segment 41, lasting until time $t_5$. Within the period $t_5-t_6$, the representative curve consists of very sharp rise in frequency 42. Finally, within the interval between $t_6$ and $t_7$, close to $t_6$, the instantaneous frequency features a drop represented by segment 43 linking up with portion 44 which prolongs portion 40 and lasts until time $t_1+T$ which is homologous with time $t_1$, one period later. The portion of the curve 46 comprising segments 41, 42 and 43 will be called an N shaped waveform. The general scope of the jamming device is still that of FIG. 1 but modulation signal generator 17 must in this case generate a signal having waveform 46 from recurrent trigger pulses. The structure of such a generator will be disclosed hereinafter.

Figure 3B:
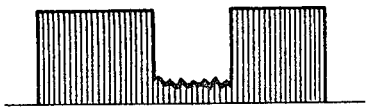

FIG. 3*b* represents the spectrum obtained with this first embodiment. Protection is of the order of 30 decibels.

Figure 4A:
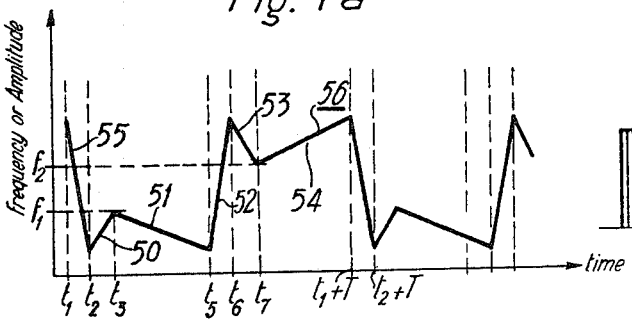

FIG. 4*a* represents both the modulation signal produced by generator 17 and the instantaneous frequency of the frequency modulated signal according to the second embodiment of the invention. Again, the frequency modulation combines with an amplitude modulaion represented by blocking pulses 18 and blocking pulses 28. Signal 56 of FIG. 4*a* is supplied to the delay-line 14. Signal 56 differs from signal 39 of FIG. 2*a* in that: during the time interval $(t_1-t_2)$, a sharp drop in frequency occurs, which is represented by segment 55. Then, the frequency abruptly rises along 50 to reach a value $f_1$ at a time $t_3$. Between time $t_3$ and time $t_5$ occurs a gradual variation 51, providing one of the two saw-teeth. From time $t_5$ to time $t_6$, the frequency rapidly goes through the whole jammer range of frequencies. Then, the frequency abruptly decreases along 53 until the value $f_2$ is reached at time $t_7$. Finally, the frequency gradually slopes-up along 54, providing the second saw-tooth extending until time $t_1+T$, homologous to $t_1$, one period later, thereafter the cycle repeats itself.

The general scope of the jamming device is still that of FIG. 1 but modulator signal generator 17 must in this case generate a signal having waveform 56 from recurrent trigger pulses. The structure of such a generator will be disclosed hereinafter.

Figure 4B:
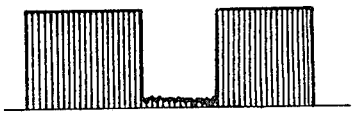

FIG. 4*b* represents the spectrum of the jamming signal in the case of modulation signal 56. It bears a close similitude to the spectrum of FIG. 3*b* but, with this embodiment, the protection figure reaches 45 to 50 decibels.

Figure 5:
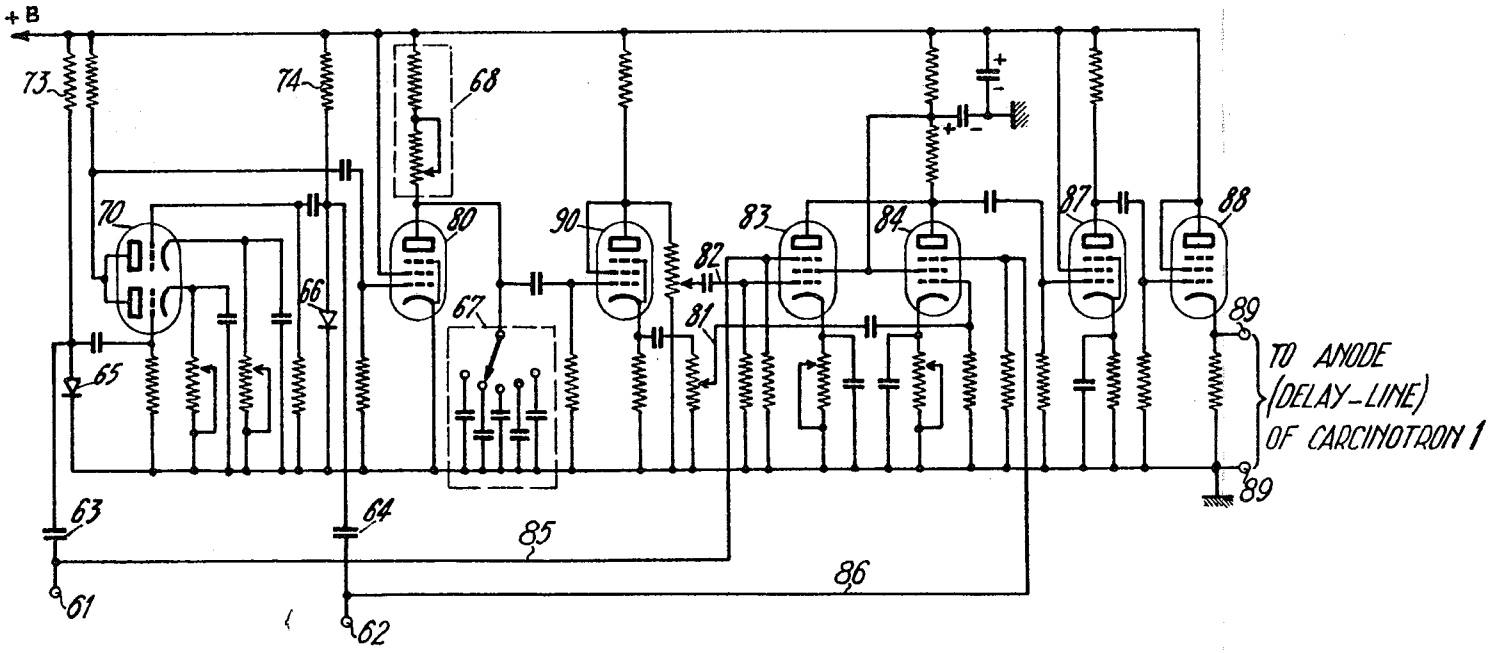
FIG. 5 represents a circuit diagram of a modulation signal generator capable of producing the modulation signal of FIG. 4*a*.

FIG. 5 shows a diagrammatic representation of the circuit of a generator 17 capable of producing the complex signal of FIG. 4*a*.

Figure 6:
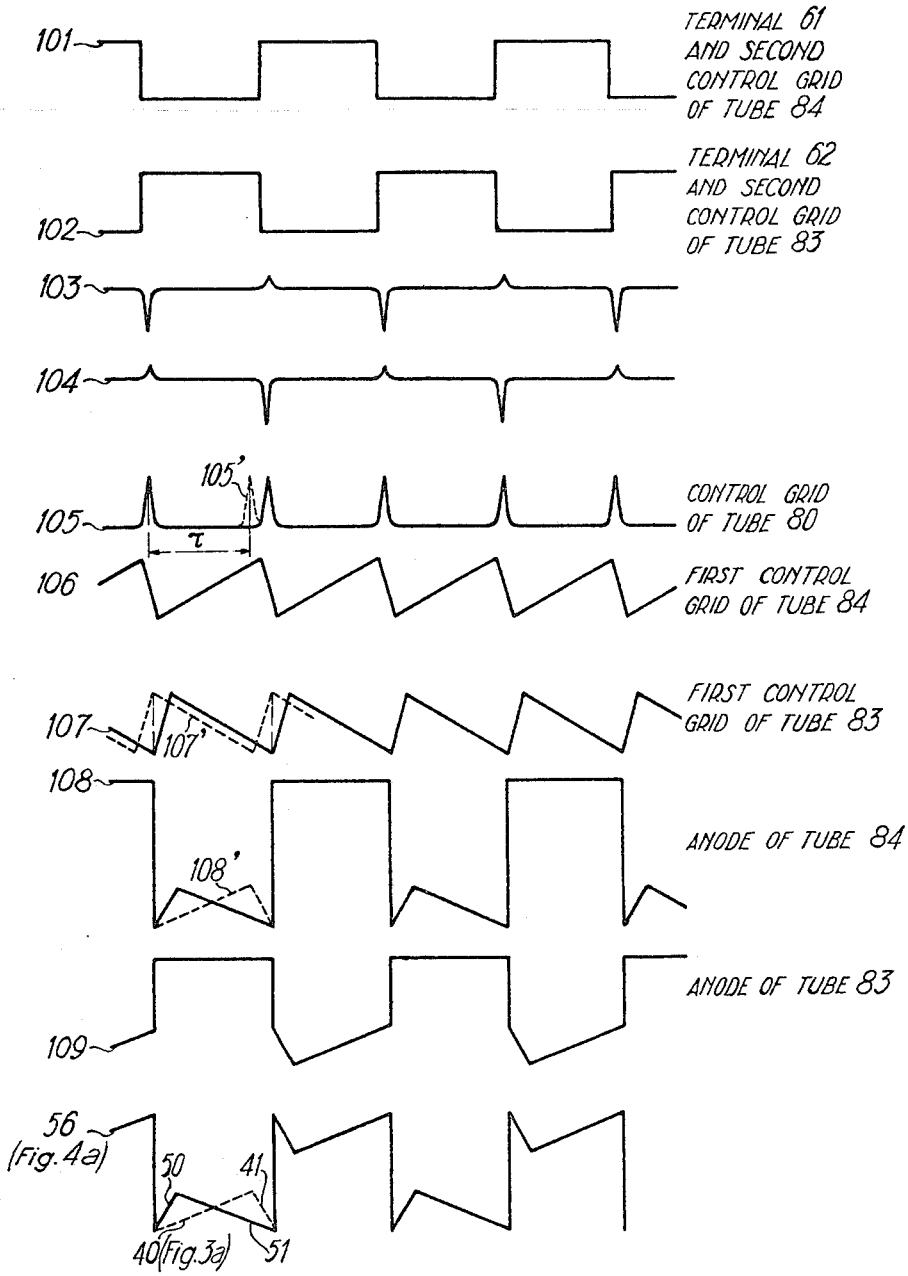
FIG. 6 shows a graph used in explaining the operations of the modulation signal generator of FIG. 5.

In FIG. 5, square-waveform signals in anti-phase are applied at recurrent frequency 1/T to terminals 61 and 62. They are represented in 101 and 102 (FIG. 6). They are differentiated by capacitors 63 and 64 and resistors 73 and 74 (FIG. 5), clipped by diodes 65 and 66 and ultimately provide signals 103 and 104 (FIG. 6). They are mixed in the double triode 70. Signal 105 (FIG. 6) appears across the load common to both sections of that tube and is fed to the grid of tube 80 (FIG. 5). The anode circuit of tube 80 embodies an integrating network comprising one of the capacitors of box 67 and resistor 68. The phase-splitter tube 90 generates on its anode and cathode respectively the two saw-teeth in antiphase 107 and 106 which are fed via conductors 81 and 82 to the first control grid of respectively tubes 83 and 84. Signals 101 and 102 (FIG. 6) are applied to the second control grids of tubes 83 and 84 via conductors 85 and 86 respectively. The two tubes produce signals 109 and 108 which are summed up in tube 87, which tube is followed by a cathode follower tube 88 generating across the output terminals 89 a signal represented at 56 in FIG. 6 which is the desired signal.

By altering the value of resistor 68 (FIG. 5) or by selecting a given capacitor in box 67, the time-constant of the integrating circuit, and consequently the amplitude of the saw-teeth 106 and 107 (FIG. 6) can be modified. This in turn modifies the width of the protected band, without altering the range of the jammed frequencies. By varying the amplitude of signals 101 and 102, both the frequency range of the jamming signals and the bandwidth of the protected band can be modified.

In FIG. 6, the forward and backward fronts of the square-waveform pulses 101 and 102 and the corresponding fronts of signals 108, 109 and 110 have been represented as vertical straight lines whereas the corresponding portions 42 and 45 of signal 46 and 52 and 55 of signal 56 have been drawn as sloping straight lines. The representation of FIG. 6 is for simplification purposes and it will be understood that the vertical fronts of the pulses and signals derived therefrom make a small angle of slope with the vertical direction.

It was not deemed necessary to give a complete diagrammatic representation of a generator circuit capable of producing signal 46 because such a circuit may be easily conceived by a man skilled in the art. For example, waveform 109 being still obtained from the combination of waveforms 101 and 107, an integrating circuit not shown allows saw-teeth 107' to be obtained from pulses 105' delayed with respect to pulses 105 by a time interval $\tau$(FIG. 6). Adding the waveforms 102 and 107' by applying them to the control grids of a tube gives waveform 108' and adding waveforms 108 and 109 gives 46 instead of waveform 56.

Figure 7:
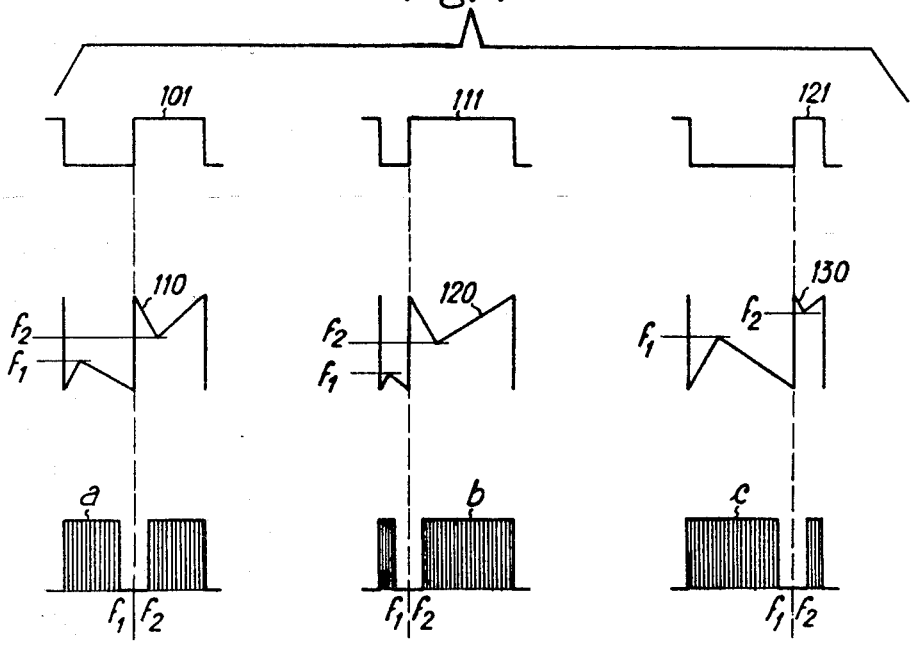
FIG. 7 shows a graph used in explaining the variation of the position of the protected band.

FIG. 7 illustrates how the protected band can be shifted within the range of jamming frequencies without the necessity for affecting their respective bandwidths.

The figure illustrates, in 101 the square waveform signal applied to terminal 61, from which is derived the modulation signal 56. In said signal the protected band in centered at the middle of the frequency deviation as represented in the amplitude frequency graph a. If the square waveform signal 101 is replaced by the rectangular waveform signal 111, the frequency modulated signal is represented at 120 and the protected band assumes the location with respect to the frequency deviation which is represented at graph b. Similarly, if the square wave signal 101 is replaced by signal 121, the protected band assumes the location represented in c.

The shifting of the protected band within the range of jammed frequencies is then obtained by replacing the square-wave signal by a signal of more or less rectangular shape. The complementary signal 102 applied to terminal 62 must be modified accordingly.

While we have described above particular apparatuses embodying our invention, it should be distinctly understood that this description is made merely by way of example and is not intended as a definition of the scope thereof. Particularly we have assumed that the blocking signals 28 were derived from the passage of microwave energy in a cavity resonator tuned onto the jam-free band. As the instantaneous frequency of a frequency modulation transmitter depends upon the amplitude of the modulation signal, the blocking signals may be derived from an amplitude comparator receiving the modulation signal and producing output signals when the amplitude of said modulation signal reaches a predetermined value.

What we claim is:

1. A jamming device adapted to jam a given frequency band with the exception of a particular jam-free band included in said given frequency band, comprising a transmitter tube generating a radiofrequency carrier signal, means for blocking said tube, means for frequency-modulating said carrier signal, means connected to said frequency-modulating means for generating a modulation signal having an amplitude versus time waveform including a first saw-tooth and a second saw-tooth, both having two portions in which respectively the amplitude of the modulation signal increases and decreases with respect to time, and a linear portion in which the amplitude of the modulation signal abruptly varies from the amplitude value at the end of the first saw-tooth to the amplitude value at the beginning of second saw-tooth, the variation direction of the modulation signal amplitude on both sides of the linear portion of the waveform being opposite the direction of said variation along said linear portion, means for deriving blocking signals from the passage of the frequency of the frequency-modulated signal through the jam-free band and means for applying said blocking signals to said blocking means.

2. A jamming device adapted to jam a given frequency band with the exception of a particular jam-free band included in said given frequency band comprising a transmitter tube generating a radiofrequency carrier signal, means for blocking said tube, means for frequency-modulating said carrier signal, means connected to said frequency-modulating means for generating a modulation signal having an amplitude versus time waveform including a first saw-tooth and a second saw-tooth, the first saw-tooth having a first portion in which the amplitude gradually increases with time and a second portion in which the amplitude abruptly decreases with time and the second saw-tooth having a first portion in which the amplitude abruptly decreases with time and a second portion in which the ampitude gradually increases with time, and a linear portion in which the amplitude of the modulation signal abruptly increases from the amplitude value at the end of the second portion of the first saw-tooth to the amplitude value at the beginning of the first portion of the second saw-tooth, means for deriving blocking signals from the passage of the frequency of the frequency-modulated signal through the jam-free band and means for applying said blocking signals to said blocking means.

3. A jamming device adapted to jam a given frequency band with the exception of a particular jam-free band included in said given frequency band comprising a transmitter tube generating a radiofrequency carrier signal, means for blocking said tube, means for frequency modulating said carrier signal, means connected to said frequency modulating means for generating a modulation signal having an amplitude versus time waveform including a first saw-tooth and a second saw-tooth, the first saw-tooth having a first portion in which the amplitude abruptly increases with time and a second portion in which the amplitude gradually decreases with time and the second saw-tooth having a first portion in which the amplitude abruptly decreases with time and a second portion in which the amplitude gradually increases with time, and a linear portion in which the amplitude of the modulation signal abruptly increases from the amplitude value at the end of the second portion of the first saw-tooth to the amplitude value at the beginning of the first portion of the second saw-tooth, means for deriving blocking signals from the passage of the frequency of the frequency-modulated signal through the jam-free band and means for applying said blocking signals to said blocking means.

4. A jamming device adapted to produce a radiofrequency frequency-modulated signal having a spectrum provided with a jam-free frequency band comprising means for generating a radiofrequency carrier signal, means for blocking said generating means, means for generating a rectangular modulation signal having an amplitude versus time waveform including a forward abrupt front, a first flat portion in which the amplitude has a first value and does not vary with respect to time, a middle abrupt front, a second flat portion in which the amplitude has a second value and does not vary with respect to time and a backward abrupt front, means for generating two identical saw-tooth signals having a maximum amplitude lesser than half the difference between the said first and second amplitude values, means for adding one of said saw-tooth signals to the first flat portion of the rectangular signal for substracting the other of said saw-tooth signals from the second flat portion of the rectangular signal whereby a complex modulation signal is obtained, means for frequency-modulating said carrier signal by said complex modulation signal, means for deriving blocking signals from the passage of the frequency-modulated signal through the jam-free band and means for applying said blocking signals to said blocking means.

* * * * *